United States Patent [19]

Dragstedt

[11] 4,362,380

[45] Dec. 7, 1982

[54] DOCUMENT FEEDER WITH VACUUM SYSTEM HAVING TWO CONTROL VALVES IN SERIES

[75] Inventor: Roger T. Dragstedt, Rochester, N.Y.

[73] Assignee: Eastman Kodak Company, Rochester, N.Y.

[21] Appl. No.: 269,168

[22] Filed: Jun. 2, 1981

[51] Int. Cl.[3] ..... G03G 15/00; B65H 3/12; B65H 5/02

[52] U.S. Cl. ..... 355/3 SH; 355/76; 355/14 SH; 271/108; 271/276

[58] Field of Search ..... 355/3 SH, 14 SH, 76; 271/96, 108, 276

[56] References Cited

U.S. PATENT DOCUMENTS

| | | | |
|---|---|---|---|
| 2,970,834 | 2/1961 | Martin et al. | 271/96 |
| 3,625,508 | 12/1971 | Shiragai et al. | 271/96 |
| 3,792,924 | 2/1974 | Matsuda et al. | 355/76 X |
| 4,052,128 | 10/1977 | Burton et al. | 355/76 X |
| 4,169,674 | 10/1979 | Russel | 355/14 SH |
| 4,176,945 | 12/1979 | Holzhauser | 355/3 SH X |
| 4,179,215 | 12/1979 | Hage | 355/14 SH X |
| 4,243,316 | 1/1981 | Gustafson | 355/3 SH X |

OTHER PUBLICATIONS

*Research Disclosure Bulletin,* Item No. 21212, Dec. 1981, pp. 440–442, "Document Feeder with Improved Vacuum System."

*Research Disclosure Bulletin,* Item No. 21140, Nov. 1981, pp. 415–418, "Document Feeder with Vacuum System Having Two Control Valves in Series" by R. T. Dragstedt.

*Research Disclosure Bulletin,* Item No. 21139, Nov. 1981, pp. 413–415, "Document Feeder with Improved Vacuum System," by Richard S. Muka.

Research Disclosure Bulletin, Item 18540, Sep. 1979, pp. 526–527, "Simplex Document Feeder and Positioner" by Gustafson et al.

Xerox Disclosure Journal, Mar./Apr. 1979, pp. 213–214, "Document Loading and Registration" by Adamek et al.

*Primary Examiner*—G. Z. Rubinson
*Assistant Examiner*—Keith E. George
*Attorney, Agent, or Firm*—G. Herman Childress

[57] ABSTRACT

A document feeder defines a sheet path along which a document sheet is fed across a platen of a copier/duplicator, for example, in order to copy the sheet. An oscillating vacuum tube feeds sheets from a supply into the sheet path. The feeder includes a platen vacuum transport having vacuum belts that move the sheet across the platen. The vacuum transport has a first vacuum plenum and a second vacuum plenum located along the sheet path. The first vacuum plenum has a relatively high level of vacuum to insure lifting of the sheet onto the vacuum belts. The sheet is then transported into the area where it comes under the influence of the second vacuum plenum. The second vacuum plenum has a somewhat lower level of vacuum, but it is sufficient to retain the sheet on the belts as the belts drive the sheet into engagement with a registration member. One vacuum blower is used to establish a vacuum in the vacuum tube and in the two plenums. Two control valves regulate the flow of air to the blower from the vacuum tube and one of the plenums. One valve controls air flow to the blower from the vacuum tube and the second control valve. The second control valve controls air flow from the first plenum to the first control valve.

4 Claims, 2 Drawing Figures

DOCUMENT FEEDER WITH VACUUM SYSTEM HAVING TWO CONTROL VALVES IN SERIES

CROSS REFERENCE TO RELATED APPLICATION

Reference is made to commonly assigned, copending U.S. patent applications Ser. No. 269,167, entitled Document Feeder With Improved Vacuum System, filed on June 2, 1981 in the name of R. S. Muka and Ser. No. 269,169, entitled DOCUMENT FEEDER WITH VACUUM SYSTEM HAVING TWO CONTROL VALVES IN SERIES, filed on June 2, 1981 in the name of John J. Konik.

BACKGROUND OF THE INVENTION

1. Field of the Invention

This invention relates to document feeders and, more specifically, to document feeders useful for feeding seriatim document sheets to a platen at an exposure station of a copier/duplicator. More particularly, the invention relates to such a document feeder having a vacuum system utilizing one vacuum blower and two control valves.

2. Description of the Prior Art

Various types of document feeders for copier/duplicators are well known in the art. For example, commonly assigned U.S. Pat. No. 4,169,674, entitled Recirculating Sheet Feeder, which issued on Oct. 2, 1979 in the name of Matthew J. Russel discloses a recirculating sheet feeder wherein a stack of document sheets to be fed to a platen of a copier/duplicator is placed in a tray. An oscillating vacuum feeder removes the sheets seriatim from the bottom of the stack for transport of each sheet by various rollers to a registration position on the platen for copying. After exposure the sheet is returned to the stack on top of the other sheets remaining in the stack.

Commonly assigned U.S. Pat. No. 4,176,945, entitled Sheet Feeding Apparatus for Use With Copiers/Duplicators or the Like, which issued on Dec. 4, 1979 in the names of R. C. Holzhauser et al. discloses a recirculating sheet feeder wherein provision is made for inverting a document sheet and returning it to the platen for copying of a second side of the document sheet prior to returning the sheet to the top of the stack. In this manner both sides of a document sheet can be copied. The Holzhauser et al. patent also discloses document positioner apparatus whereby an individual sheet is fed to the platen, copied one or more times and removed from the platen without being fed along the entire recirculating sheet path leading from the tray to the platen and back to the tray.

It is also known to provide recirculating document feeders with vacuum sheet transports for movement of a document sheet across the platen to a registration position. In this regard, see commonly assigned U.S. Pat. No. 4,179,215, entitled RECIRCULATING DOCUMENT FEEDER, which issued on Dec. 18, 1979 in the name of C. T. Hage. A combination document feeder and positioner with a platen vacuum transport is disclosed in Item 18540 at pages 526 and 527 of the September 1979 edition of Research Disclosure, a publication of Industrial Opportunities, Ltd., Homewell, Havant, Hampshire, PO91EF, United Kingdom.

A document loading and registration apparatus is disclosed at pages 213 and 214 of the March/April, 1979 edition of the Xerox disclosure Journal. The apparatus has a vacuum belt that travels over a vacuum chamber. The chamber can be separated into two sections by a movable damper or baffle that is located at a registration point. Initially, the damper is closed to isolate one section of the chamber from a vacuum blower. A document sheet is delivered to the portion of the vacuum belt above the isolated section and registered by fingers above the belt and damper. Then the damper is moved so that both sections of the chamber communicate with the vacuum blowers, and the belt is advanced across the vacuum chamber to move the sheet to a loading station.

In some of the prior art devices described above drive rollers are used for advancing sheets across the platen and against a registration member. The drive rollers continue to be driven after the sheet reaches the registration point and thereby slip on the sheet. This allows the sheet to adjust itself into a registered position and thereby eliminate skew that may have developed in the sheet as it was moved from the stack of sheets to the registration member. Generally, this continued driving of the sheet against the registration members does not adversely affect the sheet. However, in vacuum platen transports as disclosed, for example, in the beforementioned Research Disclosure Publication, the sheet may be gripped against the vacuum belt with a relatively high vacuum force. If the belt continues to drive the sheet after the sheet reaches the registration member, there may be some damage to the leading edge of the sheet, depending upon the nature of the sheet and driving force applied to the sheet. Even so, vacuum transports are desireable because they tend to minimize or eliminate skewing of the sheet as it is transported across the platen toward the registration position. Damage to the sheet can be minimized by reducing the level of vacuum applied to the vacuum belt so that the belt can move relative to the sheet after the sheet as been stopped by the registration member. However, when this occurs the vacuum transport may encounter difficulty in initially lifting the sheet off the platen and onto the belt of the vacuum transport.

The before-mentioned U.S. Pat. applications Ser. Nos. 269,167 and 269,169, disclose a document feeder having an oscillating vacuum feeder for initiating movement of a sheet along a sheet path. The sheet is fed to a platen vacuum transport with two vacuum plenums. The plenums are located adjacent a reach of vacuum belts above the sheet path so that a sheet can be tacked to the belts for transport across the platen. A higher level of vacuum is established in one of the plenums than in the other plenum. The higher level vacuum initially lifts the sheet onto the belts, and the lower level vacuum holds the sheet to the belts as the sheet is driven against a registration member. In the application filed in the name of R. S. Muka the vacuum system has a single vacuum blower and a single control valve. In the application filed in the name of John J. Konik, vacuum fluctuations that may occur in a vacuum system having a single vacuum blower and a single control valve are avoided by using one blower and one control valve for the vacuum feeder and another blower and control valve for the vacuum transport.

SUMMARY OF THE INVENTION

A sheet feeder in accordance with the present invention is useful for feeding a sheet along a path leading to a work station. Vacuum operated means coupled to a vacuum blower is effective to at least partially remove a sheet from a first position and feed the sheet into the path. Vacuum transport means receives a sheet from the vacuum operated means and advances the sheet along the path to the work station. The vacuum transport means comprises a vacuum belt located along the path, and first and second vacuum plenums. The second plenum is coupled to the blower. The vacuum transport is operable to apply a first level of vacuum to a sheet as the sheet travels along a first part of the path and to apply a second and lower level of vacuum to a sheet as the sheet travels along a subsequent part of the path. A first control valve regulates the flow of air from the vacuum operated means to the blower. A second control valve in series with the first valve regulates the flow of air from the first plenum to the blower through the first valve.

BRIEF DESCRIPTION OF THE DRAWINGS

In the detailed description of the preferred embodiment of the invention presented below, reference is made to the accompanying drawings, in which.

DESCRIPTION OF THE PREFERRED EMBODIMENT

Figure 1:
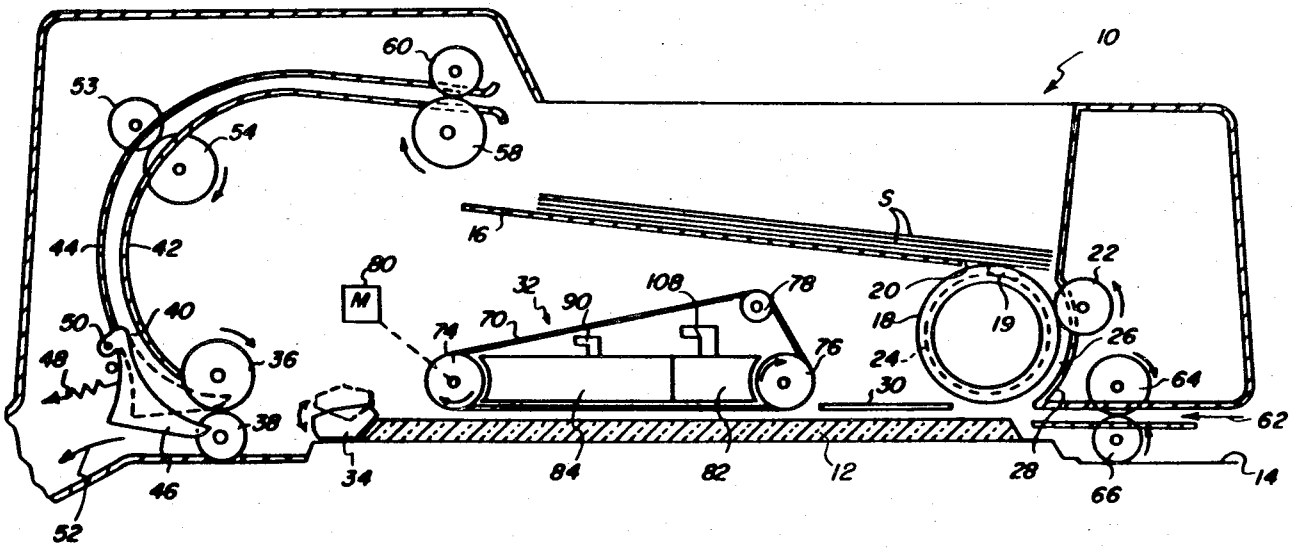
FIG. 1 is a generally schematic view illustrating a document feeder of the present invention.

Referring now to FIG. 1, a document feeder of the present invention is generally designated 10 and is shown mounted in an operative position over the platen 12 of a copier/duplicator or the like, a portion of which is shown at 14. In some respects the document feeder 10 and copier 14 are the same as, or similar to, the disclosures in the beforementioned Research Disclosure Publication and in the commonly assigned U.S. patents. Accordingly, the disclosures of such publication and patents are incorporated herein by reference.

Figure 2:
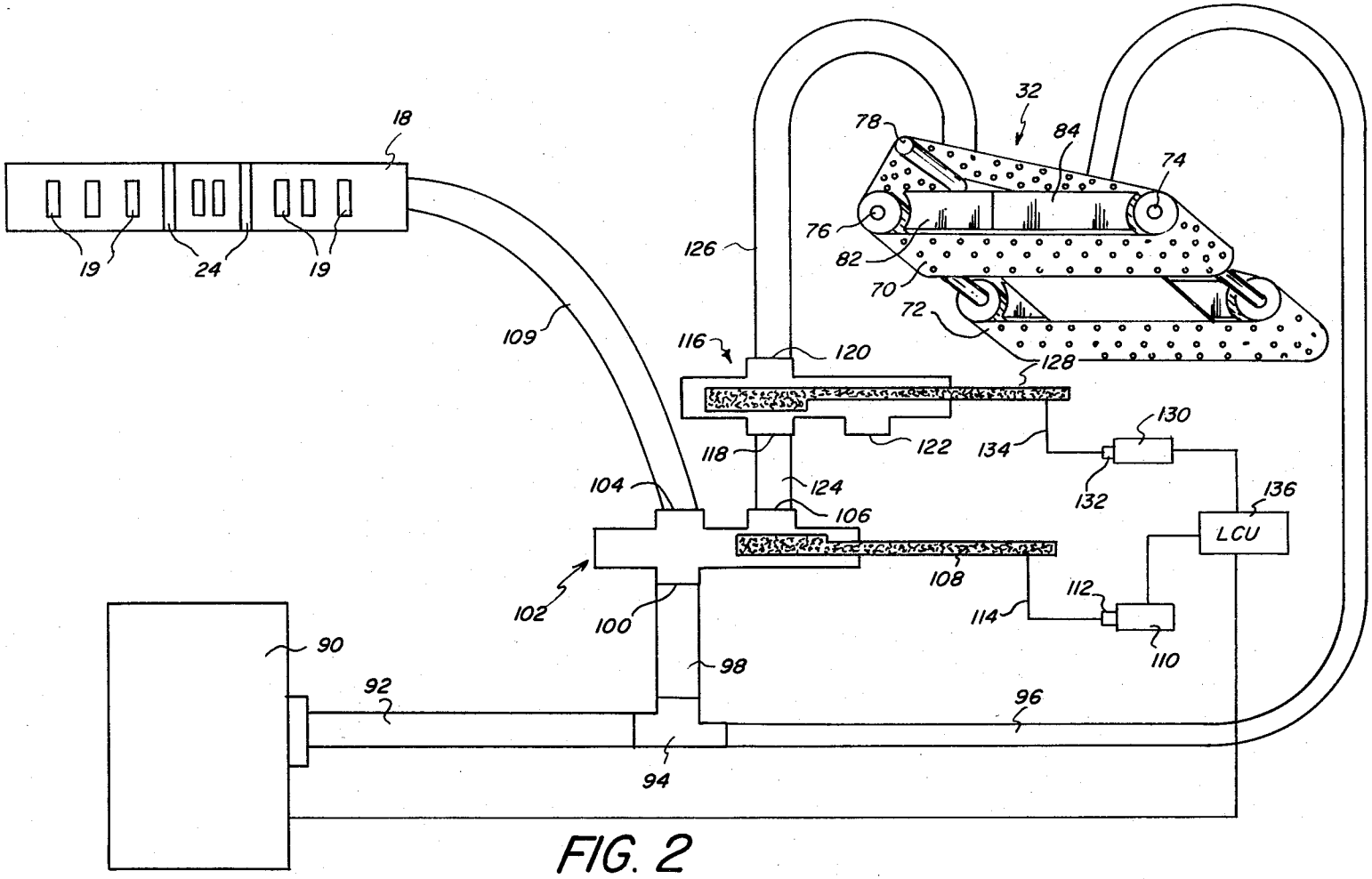
FIG. 2 is a schematic view of the vacuum system for the document feeder illustrated in FIG. 1.

The feeder 10 has a tray 16 spaced above the plate 12. The feeder is open at the top so that a set of document sheets S arranged in stack can be placed on the tray 16 for removal seriatim beginning with the lowermost sheet in the stack. Removal of the sheets from the stack is effected by a sheet feeder 18 comprising an oscillating vacuum tube. The feeder tube has a series of ports 19 arranged in a row as shown in FIG. 2. The ports are located beneath an opening 20 in the tray so that when vacuum is applied to the feeder 18 the lowermost sheet in tray 16 is attracted to the tube. Then the tube is rotated in a clockwise direction as viewed in FIG. 1 to bring the leading edge of the sheet into a nip between drive rollers 22 and rings 24. The rings are rotatably mounted on the tube 18 and recessed into the tube so that the outer surface of the rings and tube are substantially aligned. After the sheet is fed into the nip between the rollers 22 and rings 24, the tube oscillates in a counter clockwise direction back to its original position. The vacuum supply to the feeder is shut off during return movement as explained in more detail later.

The removed sheet is then fed through a guide slot 26 onto the platen 12. The guide slot 26 is defined by the surface of the tube 18, by an arcuate guide 28 adjacent to the tube, and by a flat plate 30 which is located above the platen and limits upward movement of the sheet away from the platen. The recirculating feeder structure described hereinbefore is disclosed in more detail in the beforementioned U.S. Pat. No. 4,169,674, As a sheet S is advanced across the platen 12 from right to left as viewed in FIG. 1, it reaches a platen vacuum transport generally designated 32 which will be described in more detail later. Transport 32 is effective to advance the sheet across the platen and into engagement with a registration gate member 34. Registration member 34 can be of any suitable construction and may, for example, be constructed as disclosed in commonly assigned U.S. Pat. No. 4,243,316, entitled Registration Mechanism, which issued Jan. 6, 1981 in the name of G. B. Gustafson. Preferably, transport 32 continues to urge the sheet against the registration member 34 even after initial contact therebetween so that any skew or misalignment that may exist in the sheet will be removed by allowing the driven sheet to adjust its relative position on the platen until all parts of the leading edge of the sheet are aligned with the gate member 34. When the sheet is properly aligned it is exposed by flash lamps (not shown) located beneath the platen 12 or by a scanning mechanism. An image of the document sheet is formed on a photoconductor and a copy of the document is produced in a conventional manner.

After exposure of the document sheet, gate member 34 is lifted to its dotted line position above the sheet path. Transport 32 then drives the sheet off the platen and into the nip between a pair of rollers 36 and 38. These rollers drive the sheet into a guide path 40 defined by a pair of stationary guide members 42 and 44 and a movable guide member 46. The movable guide member 46 is urged into the position illustrated by a spring shown diagrammatically at 48. However, when a sheet is to be removed from the feeder 10 after exposure (i.e., not recirculated), the movable guide member 46 is swung about a pivot 50 away from its solid line position into its dotted line position. This movement can be accomplished by any suitable moving means, such as a solenoid (not shown). When guide member 46 is in its dotted line position the sheet is deflected out of the feeder along a path shown by arrow 52.

The sheet is driven along guide path 40 by rollers 36, 38 and by two additional pair of rollers 53, 54 and 58, 60 located along the path. The sheet leaves the upper end of guide path 40 above the tray 16 and above the sheets S resting in the tray. Thus the sheet is returned to the stack of sheets on top of other sheets remaining in the stack. The result of one complete circulation of a sheet as described is that a sheet is inverted once after it is removed from the stack and before presentation for copying on the platen 12, and then inverted a second time after removal from the platen and before being returned to the tray 16. As to the set of document sheets, a sheet occupies the same position, relative to other sheets, before and after seriatim circulation of the entire set of document sheets.

The feeder has a document positioner mode of operation wherein a document sheet is fed to the platen along a non-recirculating path for copying one or more times. In this mode the sheet is fed to the feeder along a path shown at 62 in FIG. 1. The sheet is driven onto the platen 12 and into path 26 by a pair of nip rollers 64, 66. When the sheet reaches the platen vacuum transport 32, it is advanced against the registration member 34 and copied as explained hereinbefore. Then when the registration member is raised the movable guide member 46 is swung to its dotted line position and the transport 32 drives the sheet off the platen and into the nip between rollers 36, 38. Then the sheet is driven along path 52 and removed from the feeder. This document positioner mode of operation is disclosed in more detail in the beforementioned Research Disclosure Publication and in U.S. Pat. No. 4,176,945.

Referring now to FIGS. 1 and 2, the platen vacuum transport 32 preferably comprises a pair of endless vacuum belts 70 and 72 which are trained about three rollers 74, 76 and 78. Roller 74 is coupled to a motor 80 as shown schematically in FIG. 1 so that the roller 74 is driven in a clockwise direction as viewed in FIG. 1. Movement of roller 74 is effective to rotate the belts 70 and 72 about the various rollers, thereby moving the lowermost reach of the belts in a right-to-left direction as viewed in FIG. 1 for advancing a sheet toward the registration member 34. Preferably the belts 70 and 72 are of a white material and have a multiplicity of small holes therethrough through which air can be drawn for attracting a sheet to the belt. The belts are shown in FIG. 2 as being spaced from each other but they can be closely adjacent to each other or a single belt can be used if desired.

Located inside the endless belts are a first vacuum plenum 82 and a second vacuum plenum 84. The first plenum is located along the sheet path between plenum 84 and oscillating vacuum feeder 18 so that a sheet being moved along the portion of the path 26 leading from the tray to the registration member first comes under the influence of vacuum in the plenum 82 and then under the influence of vacuum from plenum 84. The plenums are closely adjacent the lower reach of the belts 70 and 72 and the plenums have openings on the lower side thereof. When air is evacuated from the plenums a partial vacuum is created in the plenums, and this partial vacuum is transferred through the openings in the bottom of the plenums and through the openings in the belts to attract a sheet to the belts.

Referring now to FIG. 2, the vacuum system for operating the oscillating vacuum feeder 18 includes a blower 90 which has its suction side connected to a conduit 92. Conduit 92 leads to a T-shaped coupling 94. A conduit 96 is connected to one branch of the coupling 94 and to the low pressure vacuum plenum 84 so that vacuum is established in plenum 84 anytime the blower 90 is operating. Conduit 96 is somewhat smaller than conduit 92.

Another conduit 98 is connected to a branch of the coupling 94 and to the inlet port 100 of a control valve generally designated 102. The control valve has two outlet ports 104 and 106 which can be opened or closed to the passage of air by an actuating member 108. Port 104 is connected to the vacuum feeder 18 by a conduit 109. In the position illustrated in FIG. 2 port 106 is blocked and port 104 is open so that operation of the blower 90 is effective to draw air from the oscillating vacuum feeder 18 through the control valve 102. Movement of the actuating member 108 to the left causes port 104 to be blocked and port 106 to be opened so that the blower 90 is then effective to draw air through port 106. Actuating member 108 is moved between its two positions by a solenoid 110 having an armature 112 that is coupled to the actuating member as shown diagramatically at 114.

A second control valve 116 has an inlet port 118, an outlet port 120 and a vent 122. A conduit 124 connects the outlet port 106 of valve 102 to the inlet port 118 of valve 116. Thus the two valves are connected in series. The outlet port 120 of valve 116 is connected by a conduit 126 to the plenum 82 of the vacuum transport 32.

Valve 116 has an actuating member 128 that is normally located in the position illustrated in the drawings wherein it closes the inlet port 118, thereby allowing air to flow through vent 122 and outlet port 120 to the plenum 82 to maintain the plenum at atmospheric pressure. The actuating member 128 can be moved to the right to cover the vent 122 and open the inlet port 118. When this occurs, and when the actuating member 108 of valve 102 is moved to the left, the blower 90 is effective to draw air from plenum 82 through conduit 126 and valve 116, then through conduit 124, valve 102 and conduits 98 and 92 to establish a partial vacuum in the plenum 82.

The actuating member 128 of valve 116 is moved between its two positions by operation of a solenoid 130 that has an armature 132 coupled to the actuating member as shown diagrammatically at 134.

A logic and control unit 136 is shown connected to solenoids 110 and 130, and to the blower 90. The use of a logic and control unit to provide a programmed sequence of operation in a copier in response to machine operator inputs and to sensing of various functions is well known in the art. Thus connections between the LCU 136 and other portions of the apparatus are not illustrated.

Preferably, plenum 82 is smaller than plenum 84. Also, a higher level of vacuum is established in plenum 82 than in plenum 84. A principal function of plenum 82 is to lift the sheet from the platen onto the lower reach of belts 70 and 72. This function is more likely to be successfully accomplished by a relatively high level of vacuum. On the other hand, a principal function of plenum 84 is to hold the sheet against the belts while the sheet is driven into registered engagement with registration member 34 without damaging the leading edge of the sheet when it is driven against member 34. Once a sheet is tacked to the belts by plenum 82, a lower level of vacuum is needed to hold the sheet to the belts. Because the belts 70, 72 preferably continue to move after the leading edge of the sheet strikes member 34, the lower level of vacuum in plenum 84 allows slippage between the belts and the sheet without damaging the leading edge of the sheet.

Operation of the apparatus will not be described. Assume initially that control valves 102 and 116 are in their respective positions as shown in FIG. 2. At this time, vent 122 of valve 116 is open and the plenum 82 is at atmospheric pressure. As to valve 102, ports 100, 104 are open and port 106 is closed. Thus when the vacuum blower 90 is operated a vacuum is established in feeder 18 and vacuum plenum 84. In response to a signal from LCU 136, the blower is started and vacuum is applied to the vacuum feeder 18. This causes the lowermost sheet S in the tray 16 to be attracted to the ports 19 of the vacuum feeder. Then, in response to a signal from the logic and control unit of the apparatus, the oscillating vacuum feeder rotates clockwise to partially withdraw the lowermost sheet S from the tray and to feed the leading edge of the sheet into the nip between the drive rollers 22 and the rings 24. Immediately after the document is fed into this nip solenoid 110 of the control valve 102 moves actuating member 108 to the left to block port 104, thereby allowing the oscillating vacuum feeder to return to atmospheric pressure. This releases the sheet from the oscillating vacuum feeder and allows it to be transported along the first portion of the feeder path by the rollers 22 and rings 24. The oscillating vacuum feeder than rotates counterclockwise to its original position.

When port 104 of valve 102 is closed, port 106 is opened. Shortly after port 106 is opened, and before the sheet reaches a position under plenum 82, the LCU signals the solenoid 130 to move actuating member 128, thereby closing vent 122 and opening port 118 so that vacuum can be applied to plenum 82. When the leading edge of the sheet reaches the space beneath the lower reach of belts 70 and 72 and beneath the vacuum plenum 82, the relatively high level of vacuum in the plenum 82 lifts the sheet up against the belts and tacks the sheet to the belts. At this time, the belts are being driven in a direction to advance the sheet along the platen towards the registration member 34. Thus the sheet travels beneath the first vacuum plenum 82 and ultimately is delivered into the area beneath the second vacuum plenum 84. As noted previously, air is continuously evacuated from plenum 84 through conduits 96, 92 and the blower 90, the level of vacuum in plenum 84 being somewhat lower than the level of vacuum in plenum 82.

For a period of time the sheet is held against the belts 70 and 72 by vacuum from both plenums 82 and 84. However, before the leading edge of the sheet reaches the registration member 34, solenoid 130 drives the actuating member 128 back to the left as illustrated in FIG. 2. This closes the valve port 118 and opens the vent 122, thereby interrupting the flow of air from plenum 82 through the valves 116 and 102 to the vacuum blower 90. The vacuum in plenum 82 is vented through vent 122 so that the plenum promptly returns to substantially atmospheric pressure. At this time the sheet is transported under the influence of vacuum from plenum 84 only. The lower level of vacuum in plenum 84 is sufficient to retain the sheet against the belts during further movement across the platen and into engagement with the registration member 34. As a result, the sheet leading edge strikes the registration member 34 with a relatively low force. The sheet can be stopped by the registration member even though the belts continue to move toward the registration member, thereby allowing any misalignment of the sheet to be corrected by continued movement of the belts. The relatively low force applied by the belts prevents any damage to the sheet while permitting relative movement between the belts and the sheet.

After the sheet is properly aligned on the platen it is illuminated to provide an image to the copier. Then the registration member is moved out of the path of the sheet and the sheet is advanced by the belts and vacuum in plenum 84 past the registration position and into the nip formed by rollers 36 and 38.

When the first sheet enters the nip between rollers 36 and 38, it is normally advanced through sheet path 40 and returned to tray 16 on top of any sheets remaining in the tray as previously explained. Alternatively, the movable guide member 46 can be swung to its dotted line position to allow removal of the sheet along the path designated 52.

After the trailing edge of the first sheet passes the registration member, the registration member is returned to the position shown in solid lines in FIG. 1 so that it can be engaged by a second document sheet to register that sheet. The cycle is repeated as required until the document sheets have all been circulated one or more times for copying.

The level of vacuum in feeder 18 and plenums 82 and 84 can be varied as required, depending upon the type and weight of document sheets to be handled. One way of adjusting the vacuum levels is to use bleeder holes in the vacuum conduits. Also, the size of the conduits used affects the vacuum level.

The vacuum system of the present invention reduces vacuum line fluctuations that may occur in other systems having a single vacuum blower. Such fluctuations are reduced by the present system by the use of two separate valves 102, 116 connected in series as described. With this arrangement, vacuum line fluctuations are comparable to the two blower system disclosed in one of the before-mentioned copending patent applications. The overall effect is good control and usage of applied vacuums. This result is achieved without loss of the desired independent control of the vacuum for the feeder 18 or plenum 82.

Two separate valves 102, 116 are shown and described herein. However, if desired these two valves can be provided in a single housing to reduce the cost and minimize the space required for the valves.

The invention has been described in detail with particular reference to a preferred embodiment thereof, but it will be understood that variations and modifications can be effected within the spirit and scope of the invention as described hereinabove and defined in the appended claims.

I claim:

1. In a sheet feeder for feeding a sheet along a path extending from a storage position to a work station, the improvement comprising:

a vacuum blower;

vacuum operated means coupled to said blower and effective to at least partially remove a sheet from the storage position and feed the sheet into the path;

vacuum transport means for receiving a sheet from the vacuum operated means and for advancing the sheet along the path to the work station, the vacuum transport means comprising a vacuum belt located along the path, and first and second vacuum plenums adjacent the belt, the vacuum transport means being operable to apply a first level of vacuum through said first plenum to a sheet as the sheet travels along a first part of the path and to apply a second and lower level of vacuum through said second plenum to a sheet as the sheet travels along a subsequent part of the path, the second plenum being coupled directly to said blower;

a first control valve for regulating the flow of air from said vacuum operated means to said blower, the first valve having an inlet port coupled to said blower, a first outlet port coupled to said vacuum operated means and a second outlet port; and a second control valve for regulating the flow of air from the first plenum to the blower, the second valve having an inlet port coupled to the second outlet port of the first valve and an outlet port coupled to said first plenum.

2. In a sheet feeder for feeding a sheet along a path extending from a storage position to a work station, the improvement comprising:

a vacuum blower;

vacuum operated means coupled to said blower and effective to at least partially remove a sheet from the storage position and feed the sheet into the path;

vacuum transport means for receiving a sheet from the vacuum operated means and for advancing the sheet along the path to the work station, the vacuum transport means comprising a vacuum belt located along the path, and first and second vacuum plenums adjacent the belt, the second plenum being coupled to said blower, the vacuum transport being operable to apply a first level of vacuum through said first plenum to a sheet as the sheet travels along a first part of the path and to apply a second and lower level of vacuum through said second plenum to a sheet as the sheet travels along a subsequent part of the path; and first and second control valves for regulating the flow of air from the vacuum operated means and the first plenum to the blower, the first valve being connected to the blower and the vacuum operated means and the second valve being connected to the first plenum and the first valve so that operation of the first valve controls vacuum in the vacuum operated means and operation of both valves is required for control of vacuum in the first plenum.

3. In a vacuum system for a document feeder, the feeder being useful for feeding seriatim a plurality of document sheets along a path having (1) a first portion extending from a stack of such sheets to an exposure position, wherein the sheets are registered and copied, and (2) a second portion leading away from the exposure position, the feeder having an oscillating vacuum member for removing a sheet from the stack and initiating movement of the removed sheet along the first portion of the path, and a vacuum transport for receiving a sheet removed by the vacuum member and for advancing the sheet along the first portion of the path toward the exposure position, the vacuum transport comprising at least one vacuum belt, a first vacuum plenum and a second vacuum plenum positioned adjacent said belt along the first portion of the sheet path so that a sheet can be attracted to the belt for transport along said path when a partial vacuum exists in at least one of said plenums, the first plenum being located along said path between the second plenum and the vacuum member; the improvement comprising:

a vacuum blower;

a first conduit directly interconnecting said blower and said second plenum;

a first control valve having an inlet port connected to said blower and having first and second outlet ports, the first outlet port being connected to the vacuum member, said control valve being adjustable between (1) a first open position wherein the second outlet port is closed and the first outlet port is open to the passage of air from the vacuum member to the blower so that a partial vacuum can be established in the vacuum member and (2) a second open position wherein the first outlet port is closed to the passage of air from the vacuum member to the blower to allow the vacuum member to return to atmospheric pressure and the second outlet port is open;

a second control valve, the second valve having (a) an inlet port connected to the second outlet port of the first valve, (b) an outlet port connected to the first plenum and (c) a vent, said second valve being adjustable between (1) a closed position wherein the inlet port is closed to the passage of air from the first plenum to the first valve and the vent is open to allow the first plenum to reach atmospheric pressure, and (2) an open position wherein the vent is closed and the inlet port is open to the passage of air from the first plenum to the first valve so that a partial vacuum can be established in the first plenum; and control means for operating said valves in a programmed sequence wherein (1) the first valve is adjusted to its first open position to temporarily establish a vacuum in the oscillating vacuum member for feeding a sheet from a stack and into the first portion of the path and the second valve is in its closed position, and then (2) the first valve is adjusted to its second open position and the second valve is adjusted to its open position to allow the oscillating vacuum member to return to atmospheric pressure and to temporarily establish a partial vacuum in the first plenum to hold the sheet against the belt while the belt moves the sheet along the first portion of the path until the sheets come under the influence of vacuum in the second plenum and then the second valve is closed.

4. In a sheet feeder for feeding a sheet along a path extending from a storage position to a work station, the improvement comprising:

a vacuum blower;

vacuum operated means coupled to said blower and effective to at least partially remove a sheet from the storage position and feed the sheet into the path;

vacuum transport means for receiving a sheet from the vacuum operated means and for advancing the sheet along the path to the work station, the vacuum transport means comprising a vacuum belt located along the path, and first and second vacuum plenums adjacent the belt, the vacuum transport means being operable to apply a first level of vacuum through said first plenum to a sheet as the sheet travels along a first part of the path and to apply a second and lower level of vacuum through said second plenum to a sheet as the sheet travels along a subsequent part of the path, the second plenum being coupled directly to said blower;

a first control valve for regulating the flow of air from said vacuum operated means to said blower, the first valve having an inlet port coupled to said blower, a first outlet port coupled to said vacuum operated means and a second outlet port;

a second control valve for regulating the flow of air from the first plenum to the blower, the second valve having an inlet port coupled to the second outlet port of the first valve and an outlet port coupled to said first plenum, and logic and control means connected to said control valves and operable to regulate the operation of said valves in a programmed sequence calling for (1) operation of the first valve to provide vacuum to said vacuum operated means to initiate feeding of a sheet into the path and (2) then operating the first and second valves to interrupt the vacuum supply to the vacuum operated means and to establish a vacuum in the first plenum, thereby to tack a sheet to the belt so the belt can transport the sheet, followed by interruption of the vacuum supply to the first plenum after the sheet comes under the influence of vacuum supply to the second plenum.

* * * * *